United States Patent [19]

Mulchi

[11] 4,064,876

[45] Dec. 27, 1977

[54] AIR-POLLUTION FILTER AND FACE MASK

[75] Inventor: Charles L. Mulchi, New Carrolton, Md.

[73] Assignee: Stanley I. Wolf, Rockville, Md. ; a part interest

[21] Appl. No.: 653,717

[22] Filed: Jan. 30, 1976

[51] Int. Cl.[2] ..... A62B 7/10

[52] U.S. Cl. ..... 128/146.6; 128/142.6; 55/DIG. 33; 55/316

[58] Field of Search ..... 128/146.6, 141 R, 140 R, 128/142 R, 142.2, 142.3, 142.6, 145.8, 146 R, 146.2, 146.3, 146.4, 146.5, 146.7, 188, 191 R, 186, 212, 202; 55/316, 387, 485, 486, 487, 524, 527, 528, DIG. 33

[56] References Cited

U.S. PATENT DOCUMENTS

| | | | |
|---|---|---|---|
| 1,789,262 | 1/1931 | Monro et al. | 55/417 |
| 1,931,989 | 10/1933 | Jenness | 23/288 |
| 1,963,874 | 6/1934 | Stampe | 55/316 |
| 2,744,525 | 5/1956 | Whipple | 128/146 R |
| 2,787,333 | 4/1957 | Boone et al. | 55/316 |
| 2,822,059 | 2/1958 | Lunn et al. | 55/487 |
| 2,855,021 | 10/1958 | Hoppe | 154/41 |
| 2,898,908 | 8/1959 | Sovinsky | 128/141 R |
| 2,910,979 | 11/1959 | Shanty et al. | 128/141 R |
| 2,922,418 | 1/1960 | Heffernan et al. | 128/142.6 |
| 3,006,346 | 10/1961 | Golding | 131/10 |
| 3,118,445 | 1/1964 | Norman | 128/141 R |
| 3,142,549 | 7/1964 | Klusewitz et al. | 128/146.6 |
| 3,170,461 | 2/1965 | Watts, Jr. | 128/146.2 |
| 3,238,056 | 3/1966 | Pall et al. | 117/98 |
| 3,464,186 | 9/1969 | Hankison et al. | 55/316 |
| 3,538,020 | 11/1970 | Heskett et al. | 210/496 |
| 3,722,510 | 3/1973 | Parker | 128/142.6 |
| 3,732,669 | 5/1973 | Chambers | 55/321 |

OTHER PUBLICATIONS

Katz et al., The Universal and the Fireman's Gas Masks, 1923, pp. 4 & 5, Technical Paper No. 300, Dept. of the Interior.

*Primary Examiner*—John D. Yasko
*Assistant Examiner*—Henry J. Recla
*Attorney, Agent, or Firm*—Berman, Aisenberg & Platt

[57] ABSTRACT

A flexible polymeric mask, which covers the mouth and at least the lower part of the nose, has exhale-valve means and vertical supporting means for air-intake filter means. The filter means provides a wearer of the mask with air which has passed, in sequence, through, e.g., porous foam, activated charcoal, filter paper, absorbent cellulose and gauze.

49 Claims, 8 Drawing Figures

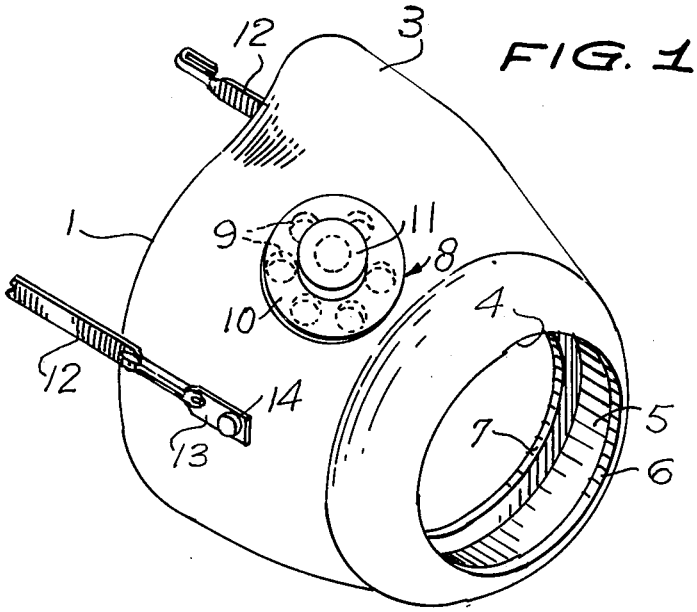
FIG. 1.
FIG. 2.
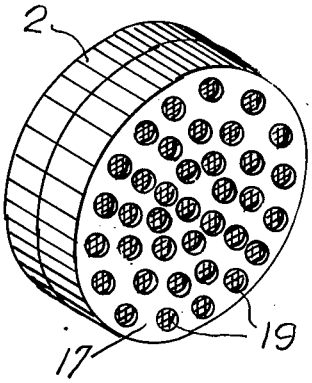
FIG. 3.
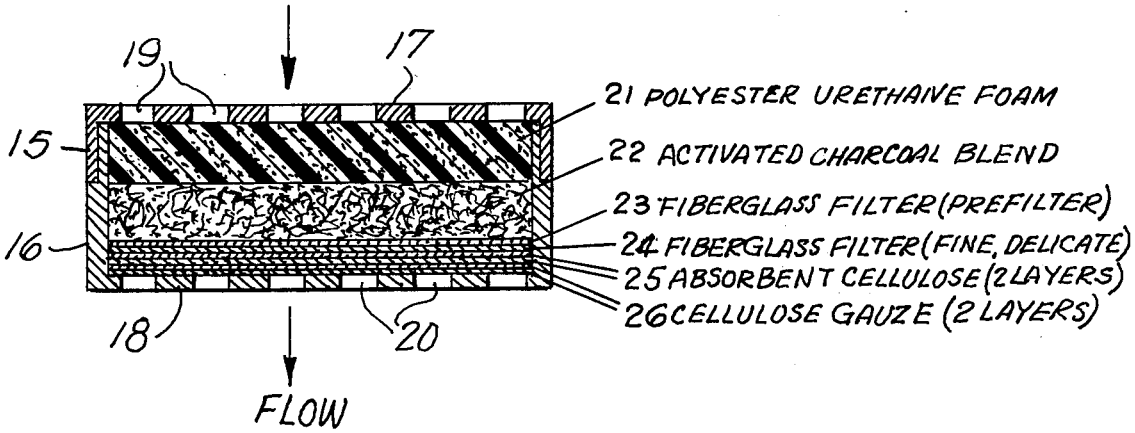

AIR-POLLUTION FILTER AND FACE MASK

BACKGROUND OF THE INVENTION

On Sept. 5, 1973, the front page of the Washington *Star-News* carried an article: "Smog Boosts Illness Rate", directed to the effects of air pollution. Health effects of polluted air were also the concern of "Sewers in the Sky " [*Medical World News,* pages 49 to 56, Oct. 19, 1973]. A wide range of obnoxious substances found in the air have been associated with health problems, particularly during periods of high air pollution, high pollen count or dust in the air. There are also occupations, such as mining and painting; industries, such as textile and chemical; and leisure pursuits, such as woodworking, which present hazards to health through the poor quality of air that is inhaled during related activities.

Most mask units commonly available to persons suffering from respiratory irritations or allergies caused by air pollutants are effective only for the removal of particulate matter. In order to obtain relief from irritating aerosol mist or gaseous oxidants, mask units similar to those developed for military or police purposes have to be acquired. These military or police masks are designed for use in lethal gas situations, and are at best awkward and cumbersome for use in environments similar to that found in urban centers during periods of air stagnation.

SUMMARY OF THE INVENTION

A filter for a wide range of obnoxious air-borne substances, a canister or cartridge containing such filter and a face mask employing the canister and filter are separate aspects of the invention to which this application is directed. A further aspect provides for a face mask from which the canister is removable and thus replaceable or disposable. The filter is constituted so that synergism is observed both in the degree of filtering accomplished and in the duration of effective service.

An object of this invention is to provide a lightweight and non-cumbersome face mask which removes impurities from air which passes through a filter therein. A further object is to provide a comfortable mask which is esthetically acceptable and adaptable to widespread outdoor use. Another object is to fit the mask with a filter which is capable of removing gaseous, vapor, mist, particulate and dust impurities from air passing therethrough. A still further object is to provide the mask with a removable and disposable filter which has interchangeable counterparts for particular environmental conditions. Additional objects include having the filter in a separate canister or cartridge for ease of handling and having the filter designed so that it can be maintained in a vertical position for extended periods of time without detriment. Other objects are readily apparent from the following description.

BRIEF DESCRIPTION OF THE DRAWING

FIG. 1 is a perspective view of a face mask without a filter.

FIG. 2 is a perspective view of a filter-containing canister adapted for use in the face mask.

FIG. 3 is a cross-section of one embodiment of the filter-containing canister shown in FIG. 2.

UNIQUE FEATURES AND ADVANTAGES

Figure 4:
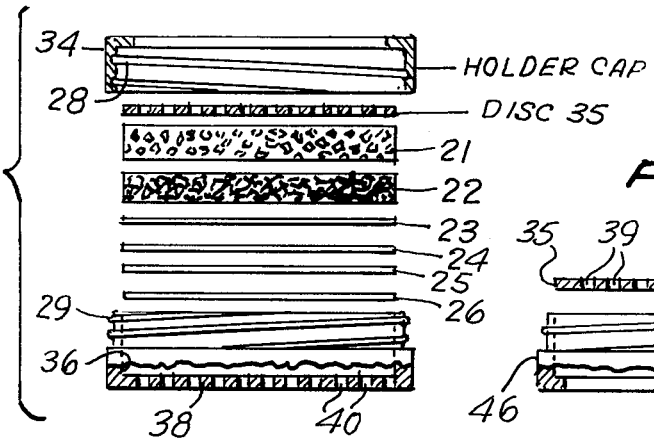
FIG. 4 is an explosion drawing (in cross-section) of an alternative cartridge construction showing the filter elements.

1. A filter-containing mask is light in weight, is comfortable to wear, is cosmetically acceptable and more esthetically appealing than traditional military-type masks.

2. A filter unit for the mask combines materials (elements) in a manner such that a wide range of air-contaminating agents are reduced to levels safe for individuals who would otherwise experience respiratory irritation, discomfort and/or allergic reaction.

3. One of the filter elements is a compressed porous foam filter means which serves a triple purpose:
   a. it filters dust and other particulate materials from air passing through it;
   b. it removes certain gasses from air passing through it when composed of polyester, e.g. polyester urethane; and
   c. it holds activated charcoal in place, eliminating the development of air channels between charcoal particles and making it practical to maintain the filter in a vertical position in normal use.

4. Although any activated charcoal is useful in the filter, highly-activated charcoal and preferably a selected blend of such highly-activated charcoal and activated charcoal impregnated with material specific to removal of certain contaminants from a gas stream coming in contact therewith provide a wider range of air-pollution filtration; properly-blended activated charcoals result in the greatest flexibility and more air-pollution filtration than a single grade of charcoal.

5. A prefilter element (downstream of the activated charcoal) also serves a triple function:
   a. it supports activated charcoal adjacent thereto and holds back fine charcoal particles;
   b. it serves as a high-capacity prefilter;
   c. it protects more delicate and more efficient downstream filter means from the activated charcoal and from particles that might otherwise reduce their capacity or longevity.

6. Absorbent cellulose and cellulose gauze (downstream of the prefilter):
   a. protect preceding filter elements (layers) from possible mechanical damage;
   b. trap moisture from exhaled air; and
   c. structurally support compressed filter components (elements).

7. The mask and filter assembly is versatile in application and construction:
   a. the size of the mask can be adapted to both children and adults, using the same filters or filter cartridges;
   b. specially-formulated filter cartridges are readily adapted for different types of applications; in areas of high sulfur dioxide concentration, the charcoal blend is adjusted for longer use under such conditions; highly-activated-charcoal enriched blends facilitate working in paint fumes, whereas impregnated charcoals specific to sulfur or nitrogen oxides offer more comfort to those in wood-working shops or other dusty environments; and c. Air-flow characteristics are readily varied to adapt the filter and mask to a wearer's needs.

8. Critical features include the actual selection of filter components which are combined in the filter unit, the order in which inhaled air passes through the respective filter components and the pressure to which components are subjected in use; an integral part of all of these features is the freedom (which they provide in combination) of air passage through the entire filter unit.

9. The components of the filter unit are arranged to provide increased service life.

10. The mask and filter unit are effective to overcome health problems associated with high air pollution and to alleviate the discomfort associated with tasks wherein a contaminated atmosphere is encountered.

DETAILS

The mask and filter unit remove from air a wide range of obnoxious substances which have been associated with health problems, particularly during periods of high air pollution, high pollen count or dust in the air. Also, the unit serves as a health aid in various occupational and leisure activities, such as mining, woodwork, chemical and textile industries, painting, etc., which involve dust or fumes. It is useful, e.g., while fumigating a house with pesticide or for entering a house which has been so fumigated. It is composed of materials which are not toxic to skin and substantially lowers the levels of a wide range of irritating substances whether they exist as solids, aerosol mists or gasses.

The unit is not a substitute for the military-type mask; it is useful in environments similar to that found in urban centers during periods of air stagnation. When properly worn by patients or persons subject to respiratory irritations, it allows them freedom to leave their homes for shopping or light work or physical exercise in their yards, etc., during periods of high air pollution. The filter unit provides an air flow rate which does not render a wearer uncomfortable while performing normal work activities and is effective for periods up to 6 weeks of regular use. Since the wearer ordinarily has no means for measuring continued effectiveness, the filter element should be replaced after, e.g., six weeks of regular use. Of course, there are certain activities, such as painting and working in extremely dusty environments, where more frequent filter changes are advisable.

The unit has been laboratory and patient tested for its effectiveness. The unit effectively removes 95% plus of oxidizing gasses, such as ozone and sulfur dioxide, at concentrations five times levels typically found in polluted urban air masses.

DESIGN & STRUCTURE

Figure 7:
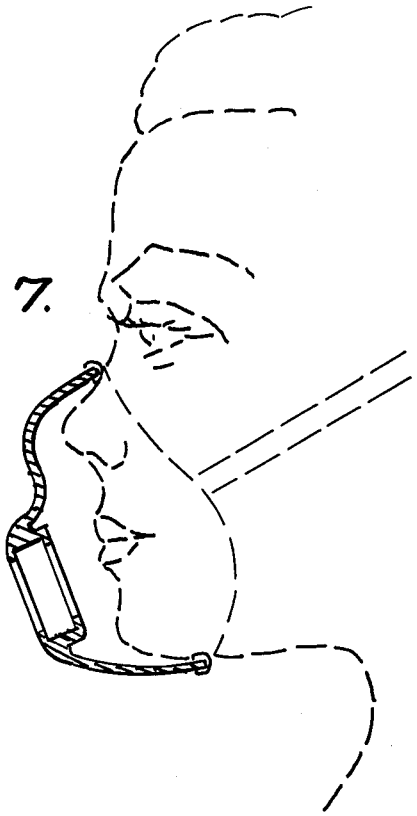
FIG. 7 is a cross-section of an alternatively-shaped mask.

The filter mask 1 (illustrated in FIGS. 1 and 7) is made from any of a wide range of materials which are moldable. The selected material is preferably flexible, i.e. has elastic qualities, so as to permit an appropriate seal about the face and to allow easy removal and snap-in of replacement filters 2. Ideally, the mask is colorless or flesh-tone to reduce negative esthetic effects to the wearer, thus making the mask more cosmetically acceptable.

RTV silicone products are exemplary of those useful for the mask. Elongation properties of such products from 150 to 180 percent are satisfactory. The tensile strength (925 psi) for GE RTV-615 is superior to that (400 psi) of GE RTV-11. Other materials suitable for mask construction include natural and synthetic rubbers, Tygon, vinyl and similar plastic materials with sufficient flexibility and elasticity to permit easy exchange of the filter element or cartridge. The actual material from which the mask is constructed is not, per se, the essence of the invention to which this application is directed.

The mask has a portion 3 which is adapted to cover at least the lower part of the nose of the wearer and a receptacle 4 for a filter cartridge 2. The receptacle is an opening through the mask in the form of a channel 5 between an outer lip 6 and an inner lip 7, the lips circumscribing the channel so as to secure therebetween a filter cartridge and to permit the insertion and withdrawal of such filter cartridge from outside of the mask. The mask preferably has valve means 8 for permitting exhaled air to exit without permitting air from outside of the mask to enter. Such valve means comprises, e.g., a plurality of holes 9 covered by a thin plastic film 10 held in place by a button or other fastening means 11. The mask is held on the head of the wearer by any suitable means, such as an adjustable elastic band 12 which is appropriately secured at its ends to fasteners 13, pivotally connected by securing means 14 to the outer surface of the mask.

Figure 6:
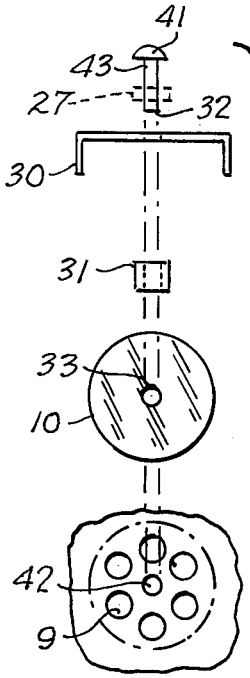
FIG. 6 is an explosion view of one form of exhale valve means.

The mask is preferably provided with two exhale-valve means. One such means is illustrated in FIG. 1; an alternative structure is shown in FIG. 6. This figure, considered along with FIG. 1, provides for covering holes (each conveniently about one-eighth inch in diameter) 9 in mask 1 with a thin plastic film or diaphragm 10 which has a diameter of about 2.1 centimeters (cm). According to this embodiment the diaphragm is protected by a protective cap 30, which may be of plastic or metal. This protective cap has a larger diameter than that of the diaphragm and physically guards the latter against inadvertent contact. A plastic pin 43, having a diameter of about one-eighth inch, a head 41 and an opposing end 32 passes through a hole in the center of the protective cap and then through a spacer 31, which separates the protective cap from the diaphragm, before passing through a hole 33 in the center of diaphragm 10 and then through hole 42 in mask 1. After such assembly of the respective parts, the end 32 of the plastic pin is softened by heat to form a flattened end 27 and thus secure the respective parts of the valve together and to the mask.

The filter cartridge is of any of numerous materials, sizes and shapes, but is conveniently of a fairly rigid plastic material and in the form of a hollow right circular cylinder having perforated bases at opposite ends thereof.

The filter holder (cartridge or canister) is optionally made from any of such diverse plastic materials as acrylic resins, e.g. polymethylmethacrylate; polyamide resins, e.g. nylon; polyethylene; polystyrene and vinyl resins. It is alternatively made from metals, such as aluminum. The key requirements are moldability, rigidly of final structure and chemical and physical resistance to moisture, dust, smog and mist.

The physical size of the holder ordinarily ranges from 5 to 7 centimeters (cm), e.g. 55 millimeters (mm), in diameter (or provides a comparable surface if of a shape other than round) and from 12 to 16, e.g. 13, millimeters in total thickness. The materials used average 2 ± 0.2 millimeters in thickness depending on their hardness.

The two halves of the holder are joined by friction, cement, tape, threads, or any other available holding means.

The size and distribution of perforations in the filter holder are readily varied over a wide range but preferably average at least 50 percent of the surface area. Since the filter holder is moldable, these perforations are, e.g., rectangular (such as those of a screen mesh) or circular. For a 5 centimeter holder, a 50-percent open surface equals 9.8 $cm^2$ in area, which is accomplished by 77 perforations 4 millimeters in size, 50 perforations 5 millimeters in size or 35 perforations 6 millimeters in size. A larger unit would have a proportionately larger number of perforations. The perforations should be uniformly distributed over the area.

With a removable screen for one or each of the flat surfaces, it is possible to provide a cap with threads on the basic holder. This allows the contents to be compressed with the screen, and the cap secured while the contents are under compression.

The inside diameter of the unit should be kept within 4.6 to 6.6 centimeters with a thickness of 8 to 12 millimeters. Larger units are possible but not as pleasing to the onlooker. Smaller units sacrifice something in air flow and/or efficiency and the resulting comfort.

The cartridge is readily prepared from two fitted sections 15 and 16 which are secured together (after assembly) by any suitable means, such as adhesive or a mechanical interlocking means. As shown in FIG. 3, section 15 is upstream and section 16 is downstream. In both base 17 through which air enters the filter cartridge and base 18 through which filtered air passes into the mask are perforations 19 and 20, respectively. Such perforations are conveniently in the form of circular holes about 5 mm in diameter and as close together as the strength of the cartridge base will permit. The holes are naturally over the entire extent of the entry base 17 so that the contained filter will be used as evenly as possible.

Figure 5:
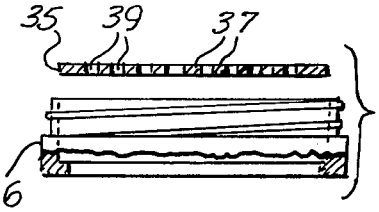
FIG. 5 is a cross-section of a variation of the holder body of FIG. 4.
Figure 8:
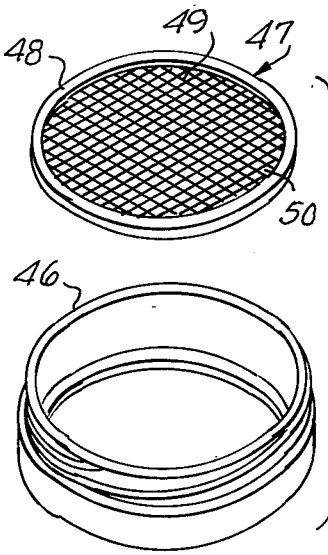
FIG. 8 is a perspective view of the holder body of FIG. 5 with an alternative form of disc.

The cartridge structure is readily varied to a considerable extent without departing from the subject teachings. In this regard FIGS. 4, 5 and 8 provide alternative embodiments. FIG. 4 shows a hollow holder body 36 with a base 40 having perforations 38. This holder body has a threaded neck portion remote from the base and bearing external threads, e.g. about eight per inch, 29. The filter elements (21 through 26, inclusive) are sequentially piled on the inside of the base 40, followed by a perforated disc 35. By depressing the disc, thus compressing foam layer 21 so that the entire filter assembly fits within the holder body, holder cap 34, with grooves 28 (matching threads 29 of holder body 36), can be screwed and thus secured to the holder body.

Holder body 46 (FIGS. 5 and 8) can be substituted for holder body 36 without changing the assembly of the filter and cartridge. When holder body 46 is employed, a filter disc, such as perforated disc 35 (FIG. 5) or mesh disc 47 (FIG. 8), supports the filter elements within the cartridge and permits sufficient gas to flow therethrough. Mesh disc 47 comprises a frame 48 in which the respective ends of mesh 50 are secured, e.g., by crimping or melting (when the frame 48 is plastic). The sole requirement for the mesh disc (other than its strength) is that the spaces 49 must comprise at least as much area as the mesh 50.

The mesh disc 47 is completely interchangeable with the perforated disc 35 for either a holder cap 34 or a holder body 46.

When a fine mesh is employed in a mesh disc in holder body 46 (for the cartridge), gauze layer 26 or its equivalent may be omitted.

When a gas is passed through a filter, a pressure drop is necessarily created. The gas flow and pressure drop are directly proportional. The size of the unit also affects the gas flow. For a 5-centimeter diameter cartridge unit, a flow rate of, e.g., 50, or even as high as 70, liters per minute and a pressure drop of 4 ± 2 centimeters of water are encountered for this invention. The higher flow rates correspond to the higher pressure drops, etc. As is appreciated, the minimum flow rate is not critical. For larger diameter cartridge units, correspondingly higher flow rates are obtained. Also, these parameters vary with the particular materials in the filter.

The essential components of the preferred filter in the order in which they are contacted by air entering the filter from outside of the mask are: a filter foam 21, such as a polyester urethane foam; activated charcoal 22, preferably in the form of a blend; a prefilter 23 (this element is not actually essential to the invention and is dispensable, particularly when the preceding two components are combined); a fine delicate filter 24; absorbent cellulose 25, preferably two layers; and cellulose gauze 26, preferably two layers, but dispensable under conditions previously mentioned. Elements can be repeated or divided; for example, the filter foam can be divided so that part is before and part is after the activated charcoal. Other elements can be added, but the noted components and the indicated sequence are significant factors in the obtained results.

In preparing the filled cartridge, the filter components are best fitted into cartridge element 16 in reverse order, starting with the cellulose gauze and ending with the filter foam, which is then compacted by pressing cartridge section 15 thereover. The compaction of the foam secures particulate activated charcoal so that the filter unit may be employed for extended periods in a vertical position, i.e. a position wherein the respective bases are essentially perpendicular to the horizontal, with virtually no shift in the relative position of the activated charcoal particles.

After the filter components are in place in filter cartridge section 16 and cartridge section 15 is interlocked or otherwise secured thereupon, the cartridge is ready for introduction into channel 5 of the receptacle in mask 1.

SPECIFIC EMBODIMENTS

A filter unit (FIG. 3) consists of a clear plastic perforated holder or cartridge 2 which separates into two interlocking parts 15 and 16. The size of the holder (5 cm or 2 inches in diameter) is subject to variation within reasonable limits. This is also true with regard to the size (5 mm or 3/16 inch in diameter) of holes in the unit. For example, adult sizes may be larger. During manufacturing, the two interlocking parts are, e.g., cemented together to eliminate accidental separation during handling.

The first (outer) filter component consists of a layer of polyester urethane foam (Scott Filter Foam). In prototype testing, a thickness of 12 mm (0.5 inch) performs satisfactorily. The texture of the foam may be varied, but a texture of 100 pores per linear inch is recommended for removal of large dust, pollen grains and particulate matter from an air stream passing therethrough. Grades of foam with as few as 45 pores per linear inch are also useful for this component, but removal of smaller particulate material is sacrificed. The polyester urethane foam is highly porous and thus offers little resistance to air flow. The polyester urethane foam reacts with certain gasses, such as ozone, with oxidant properties. Having the urethane foam upstream of the activated charcoal thus has a tendency to prolong the activated-charcoal effectiveness somewhat. However, the primary function of the polyester urethane layer is removal from an airstream of dust, particulate matter, pollen and aerosol mist droplets. The polyester urethane layer is compressed to a thickness of approximately 5 mm with a force of approximately 20 ± 3 $gm/cm^2$. The compaction serves a vital purpose of holding the activated charcoal layer in place.

Other foam materials made from similar or related plastic materials are alternatively used provided that they conform to the uniform properties, i.e. filter grade, demonstrated by the Scott product. The range in foam thickness is 1 ± 0.5 cm prior to compaction.

Since the outer layer serves primarily as a rough filter to remove dust, pollen grains, etc., other filter materials, such as cotton or cellulose pads and glass fiber pads, which perform in a similar manner (providing they are filter grade materials with uniform air flow properties and uniform porosity) are substitutable for the filter foam. These materials provide the necessary compression resistance to hold the activated charcoal in place, especially when the proper thickness is utilized. Alternatively, a coarse glass fiber pad with activated charcoal granules suspended within the fibers is used as the first filter component. This effectively combines the first two filter components into a single component and reduces or eliminates the need for the third filter component, the prefilter.

The second component in the filter is a layer of activated charcoal. The general effectiveness of activated charcoal for removing a broad spectrum of compounds from air is well known. Irritating gasses, such as oxidants, e.g. ozone, are effectively removed. The charcoal in the filter is any commercial-grade activated charcoal, such as Barnebey-Cheney PC 9942, but is preferably a blend of activated charcoals. In prototype testing, a 50—50 mixture of activated charcoal impregnated with substances specific for sulfur and nitrogen oxides (Barnebey-Cheney-CH 2286) was combined with highly-activated charcoal (Barnebey-Cheney-PE 9395). This combination proved highly effective for oxidant and sulfur oxide removal. Also in prototype testing, charcoal granules sieved through a 12 × 30 mesh screen provided necessary surface area for effective filtration. Since the size of charcoal granules controls the absorptive surface area and hence the activity of the charcoal, the effectiveness of the filter is somewhat regulated by varying the size of the granules.

The granule sizes may vary from material which passes through a U.S. Sieve Series (ASTM E11) No. 7(2.80 mm) down to No. 30 (0.60 mm). Larger granules may not provide the necessary surface area for the level of sustained activity for a six- to eight-week service life. Smaller granules tend to compact, thus blocking the air flow through the filter. It is preferred that the granules be uniform and average those which pass through U.S. Sieve Series No. 18 (1.0 mm).

Granules smaller than No. 30 (0.6 mm) are, alternatively, suspended in the preceding filter pad, thus combining elements 1 and 2 into a single element. Such an arrangement provides a highly effective element due to the large surface area of the charcoal. With this combined-element arrangement, however, dust loading of the filter pad tends to block the filter and make it difficult to obtain adequate air flow after several weeks in use.

The amount of charcoal needed for a given filter depends on the size of the holder and size of the charcoal granules. In prototype testing (for the 5 centimeter holder) 5 grams of 50—50 blend of B.C. (Barnebey-Cheney) PE 9395 and B.C. CH 2286 which passes through U.S. Sieve Series No. 18 (1.0 mm) yield up to six weeks of effective oxidant removal.

When smaller granule sizes are used, less material is necessary due to the increase in charcoal activity resulting from the increased surface area. A suitable suggested range (for a 5 cm holder) includes from 3 grams of 0.6 mm material to 6 grams of 2.8 mm material. Larger-sized holders need proportionately larger quantities - e.g. 1.5 × for holders 6 cm to 2.0 × for holders 7 cm in diameter (factors based on surface areas for the respective holders compared to that of the 5 cm unit).

The charcoal granules are held in place by the compressed polyester urethane layer, thus eliminating any development of air channels through which pollutants may escape removal.

The structural element which immediately follows the charcoal layer is an optional prefilter. Its primary purpose is to protect the more delicate filter, which it precedes, from either being crushed by the charcoal or being plugged by charcoal dust or other large particulates which may have escaped removal by the foam. Its removal would permit a drop in flow resistance; however, the risk of damage to the delicate filter layer is increased. When the foam and charcoal layers are replaced by a charcoal-impregnated pad, the structural element is not as necessary and may be omitted.

In prototype testing a very low-resistant filter paper (Hollingsworth & Vose - H-60 FG) composed of glass fibers and organic binder was very satisfactory due to its high loading volume and low resistance to air flow. This element is replaceable by a wide range of commercially available glass fiber materials which have uniform porosity, which have low air flow resistance and which provide the necessary structural protection to the more delicate element which it precedes.

The thickness of this third filter element is not as critical as the filtration performance and air flow properties. When present, a preferred thickness is 0.6 ± 0.3 mm.

The filter layer serves as a pre-filter to the more efficient layer which follows. It serves to trap dust, etc., which passes through the foam and charcoal layers and dust from the charcoal. One of its key purposes is to protect the more delicate and efficient following layer from being crushed by compressed charcoal granules.

The fourth filter component has the primary function of removing the smaller particulate matter. The quality of this element determines the maximum efficiency of the overall unit for particulate removal. It also determines the overall flow properties and air resistance for the unit.

Depending on the desired level of overall efficiency of removal of smaller-sized particulate fractions, there are at least two grades of materials which are useful for the fourth filter component. Hollingsworth and Vose Co. produces H-75 FG and H-90 papers, which are both suitable components. The H-75 FG has been rated at 60% efficiency for particulate matter 0.3 micron in size. The H-90F is less efficient than the H-75 FG for particulate matter 0.3 micron in size, but has a much lower resistance to air flow. With H-75 FG, the pressure drop across the filter at 33 liters/minute flow rate is 3.5 cm of water, whereas, with H-90F, the pressure drop at a similar flow rate is 3.2 cm of water. The H-75 FG is composed of glass fibers, and the H-90 F is composed of glass fibers and cellulose fibers. Both filters yield a satisfactory level of filtration for most general usages.

In prototype testing, the H-60FG was satisfactorily used as a prefilter in conjunction with each of H-75FG and H-90F. However, there are cases where a lower flow resistance than that provided by either of the more efficient materials is desired. Two layers of H-60 FG provide a minimum level of suitable filtration for the unit.

These elements are replaceable by any commercially-available materials with superior or equivalent filtration and/or flow properties. Their thickness is not as critical as their filtration performance. A suitable thickness is 0.6 ± 0.3 mm.

The fifth component in the filter is composed of (preferably two layers of) absorbent cellulose. The fifth layer serves the dual purpose of protecting the glass fiber layers preceding it from possible mechanical damage from inside the mask plus serving as a moisture vapor trap. The preferred dual layers offer filtration to trap possible loose glass fibers which may enter the air stream. Their primary functions are to protect the preceding layers and to trap moisture in exhaled air.

The absorbent material has an open texture which promotes low air resistance.

In prototype testing, several types of materials performed satisfactorily. Most were open-textured paper type materials not rated for their filtration properties. However, there are woven cellulose fabric materials commercially available which serve as suitable substitutes. A thin layer of surgical cotton is an ideal substitute. A thickness of 1.5 ± 0.5 mm is adequate.

The sixth and final component in the filter is composed of (preferably two layers of) cellulose. The cellulose serves to protect the preceding layers and to offer structural support for the compressed components, especially over the air holes in the holder. A cellulose gauze layer aids in trapping moisture in exhaled air and in releasing moisture vapor into inhaled air.

There are many substitute materials available, including gauze made from various synthetic products. When the filter holder is of the mesh type with uniform grids of 1 to 2 mm square perforations, this element may be omitted altogether, since the internal components are adequately protected.

Compressing filter foam from 12 mm to 5 mm requires a pressure of 20 ± 3 gm/cm$^2$. The charcoal, however, does not need a force of this magnitude to prevent shifting. A force of 4 ± 1 gm/cm$^2$ is sufficient. It is important for the charcoal to remain in place. The minimum force for such purpose is all that is required.

The entire filter is compressed into an overall thickness of from approximately 8 to approximately 12 mm within the holder.

The described filter unit provides air flow rates of, e.g., 50 ± 20 liters per minute (per circular section of about 5 cm in diameter) at a pressure drop of 4.0 ± 2.0, preferably at most 4.0, cm water. The air flow and pressure characteristics are satisfactory for normal usage and should not prove uncomfortable to most wearers while performing normal work activities. The flow rate and pressure drop may be varied by substituting materials with different porosity ratings and/or increasing the effective diameter of the filter surface. To increase the flow rate or decrease the pressure drop appreciably, more-porous components are necessary. However, such substitutions have a tendency to reduce the effectiveness of the filter for removal of smaller-sized particulate fractions, but should not appreciably affect effectiveness for removing noxious gasses.

The filter provides two-way synergism - synergism in service life and synergism in the amount of contaminants actually removed from a gas stream passing therethrough. By the arrangement of filter elements, dust-loading of the charcoal is minimized, thus increasing its effective service life and its effective capacity during service.

The invention and its advantages are readily understood from the foregoing description. It is apparent that various changes may be made without departing from the spirit and scope of the invention or sacrificing its material advantages. The forms hereinbefore described and illustrated in the drawings are merely those of preferred embodiments.

What is claimed is:

1. A filter having a plurality of component elements which, in combination, provide means for passing a gas stream therethrough at a flow rate which, per circular section of about 5 centimeters in diameter, is in the range of from 50 ± 20 liters per minute at a pressure drop of at most about 6.0 centimeters of water, the elements comprising, in sequence:

i. porous compressible means to filter contaminated gas;

ii. particulate activated charcoal means;

iii. low-resistant prefilter means to supplement physical filtration provided by (i);

iv. low-resistant filter means for filtering particulate matter as small as 0.3 micron in diameter;

v. absorbent means to trap moisture and to protect (iii) and (iv) from mechanical damage; and vi. means to support and protect preceding elements;

the porous compressible filter means providing means for removal of large dust particles, pollen grains, other particulate matter and aerosol droplets from the gas stream; the particulate activated carbon means providing means for removal of irritating gases from the gas stream; each element being in direct contact with adjacent elements, exerting a positive pressure against such adjacent elements to maintain them in position and having its designated function under such pressure.

2. A filter according to claim 1 which comprises the following component elements in sequence:

a. porous foam filter means for removal of large dust particles, pollen grains, other particulate matter and aerosol droplets from the gas stream and having from 70 to 110 pores per linear inch, b. particulate activated charcoal means for removal of irritating gases from the gas stream, c. low-resistant prefilter means to supplement physical filtration provided by (a) and (b), to retain dust and other particles in the activated charcoal means and to protect subsequent elements against being crushed by granules in the particulate activated charcoal means, d. low-resistant filter means for filtering particulate matter as small as 0.3 micron in diameter,
e. absorbent means to trap moisture and to protect (c) and (d) from mechanical damage, and
f. gauze means to support and protect preceding elements.

3. A filter according to claim 2 wherein foam filter means (a) is polyester foam.

4. A filter according to claim 3 wherein the polyester foam is polyester urethane foam having about 100 pores per linear inch.

5. A filter according to claim 4 wherein prefilter (c) is low-resistant filter paper.

6. A filter according to claim 5 wherein prefilter (c) is composed of glass fiber and organic binder, and low-resistant filter (d) is filter paper.

7. A filter according to claim 6 wherein low-resistant filter (d) contains fibers which are essentially only glass fibers.

8. A filter according to claim 6 wherein low-resistant filter (d) contains glass fibers and cellulose fibers.

9. A filter according to claim 6 wherein the activated charcoal is a blend of highly-activated charcoal and charcoal impregnated with substances specific for removal of certain contaminants from a gas stream coming in contact therewith.

10. A filter according to claim 6 wherein porous foam filter means (a) is compressed to exert a pressure sufficient to keep particles of the activated charcoal means from moving with respect to each other in normal use even when the filter is in a vertical position.

11. A filter according to claim 4, further enclosed within a cartridge having a cylindrical hollow casing with two opposed essentially flat perforated surfaces through which gas can pass, the hollow casing being filled with filter elements under compression and in a fixed sequence between one of the flat perforated surfaces and the other; each filter element having opposed surfaces lying essentially in parallel planes and substantially coextensive with the opposed perforated surfaces and arranged so that gas passing through the cartridge must pass through each filter element.

12. A cartridge filter according to claim 11 wherein the compression is that exerted by foam filter means (a) and is sufficient to maintain the cartridge filter in a vertical position without relative movement between particles of the particulate activated charcoal means.

13. A cartridge filter according to claim 12 wherein the hollow casing is a clear plastic holder composed of two interlocking parts.

14. A cartridge filter according to claim 13 wherein the flat perforated surfaces have perforations virtually throughout their entire extent so that all portions of the contained filter elements are essentially equally exposed to whatever passes through the cartridge.

15. A cartridge filter according to claim 14 wherein the pressure drop is at most 4.0 centimeters of water.

16. A filter according to claim 1, further enclosed within a cartridge having a cylindrical hollow casing with two opposed essentially flat perforated surfaces through which gas can pass, the hollow casing being filled with filter elements under compression and in a fixed sequence between one of the flat perforated surfaces and the other; each filter element having opposed surfaces lying essentially in parallel planes and substantially coextensive with the opposed perforated surfaces and arranged so that gas passing through the cartridge must pass through each filter element.

17. A cartridge filter according to claim 16 wherein supporting and protecting means (v) is absorbent means which traps moisture.

18. A filter according to claim 16, in combination with a moldable polymeric face mask which is adapted to cover a wearer's mouth and nostrils and which has gas-outlet valve means, the filter being enclosed in a cartridge in a manner in which said cartridge is removably secured to said mask.

19. A filter and facemask combination according to claim 18 wherein the removable cartridge filter is maintained in a vertical position in normal use.

20. A filter according to claim 1, and further enclosed within a cartridge having a cylindrical hollow casing with opposed upstream and downstream essentially flat perforated surfaces through which gas can pass, the hollow casing being filled with filter elements under compression and in a fixed sequence between one of the flat perforated surfaces and the other; each filter element having opposed surfaces lying essentially in parallel planes and substantially coextensive with the opposed perforated surfaces and arranged so that gas passing through the cartridge must pass through each filter element; the downstream essentially flat perforated surface comprising sufficiently fine mesh to provide means (vi) of claim 1.

21. A filter according to claim 1, in combination with a moldable polymeric face mask which is adapted to cover a wearer's mouth and nostrils and which has gas-outlet valve means, said filter being maintained in normal use in a vertical position.

22. A filter and facemask combination according to claim 21 wherein the filter elements are arranged so that air passing through the filter means from outside of the mask passes first through porous compressible means (i) and last through support means (vi) before being accessible to one who wears the mask.

23. A filter and facemask combination according to claim 22 wherein the polymeric face mask is flexible.

24. A filter and facemask combination according to claim 23 wherein said face mask is cosmetically-acceptable and which permits a user thereof to perform normal work activities in comfort.

25. A filter and facemask combination according to claim 24 which, in use, reduces gaseous, vaporous and particulate air contaminants to a safe level.

26. A filter having a plurality of component elements which, in combination, provide means for passing a gas stream therethrough at a flow rate which, per circular section of about 5 centimeters in diameter, is in the range of from 50 ± 20 liters per minute at a pressure drop of at most about 6.0 centimeters of water, the elements comprising, in sequence:

i. particulate activated charcoal means intermeshed in porous compressible means to filter contaminated gas;
ii. low-resistant prefilter means to supplement physical filtration provided by (i);
iii. low-resistant filter means for filtering particulate matter as small as 0.3 micron in diameter;
iv. absorbent means to trap moisture and to protect (ii) and (iii) from mechanical damage; and
v. means to support and to protect preceding elements; the porous compressible filter means providing means for removal of large dust particles, pollen grains, other particulate matter and aerosol droplets from the gas stream; the particulate activated carbon means providing means for removal of irritating gases from the gas stream; each element being in direct contact with adjacent elements, exerting a positive pressure against such adjacent elements to maintain them in position and having its designated function under such pressure.

27. A filter according to claim 26 which comprises the following component elements in sequence:

a. particulate activated charcoal means for removal of irritating gases from the gas stream and intermeshed in porous foam filter means for removal of large dust particles, pollen grains, other particulate matter and aerosol droplets from the gas stream and having from 70 and 110 pores per linear inch;
c. low-resistant filter means for filtering particulate matter as small as 0.3 micron in diameter;
d. absorbent means to trap moisture and to protect (c) from mechanical damage, and
e. gauze means to support and to protect preceding elements.

28. A filter according to claim 27 which comprises the following elements in sequence:

a. particulate activated charcoal means for removal of irritating gases from the gas stream and intermeshed in porous foam filter means for removal of large dust particles, pollen grains, other particulate matter and aerosol droplets from the gas stream and having from 70 to 110 pores per linear inch;
b. low-resistant pre-filter means to supplement physical filtration provided by (a), to retain dust and other particles in the activated charcoal means and to protect subsequent elements against being crushed by granules in the particulate activated charcoal means;
c. low-resistant filter means for filtering particulate matter as small as 0.3 micron in diameter;
d. absorbent means to trap moisture and to protect (b) and (c) from mechanical damage, and
e. gauze means to support and to protect preceding elements.

29. A filter according to claim 28 wherein prefilter (b) is low-resistant filter paper.

30. A filter according to claim 29 wherein prefilter (b) is composed of glass fiber and organic binder, and low-resistant filter (c) is filter paper.

31. A filter according to claim 30 wherein low-resistant filter (c) contains fibers which are essentially only glass fibers.

32. A filter according to claim 30 wherein low-resistant filter (c) contains glass fibers and cellulose fibers.

33. A filter according to claim 30 wherein the activated charcoal is a blend of highly-activated charcoal and charcoal impregnated with substances specific for removal of certain contaminants from a gas stream coming in contact therewith.

34. A filter according to claim 27 wherein foam filter means (a) is polyester foam.

35. A filter according to claim 27 wherein the polyester foam is polyester urethane foam having about 100 pores per linear inch.

36. A filter according to claim 29, further enclosed within a cartridge having a cylindrical hollow casing with two opposed essentially-flat perforated surfaces through which gas can pass, the hollow casing being filled with filter elements under compression and in a fixed sequence between one of the flat perforated surfaces and the other; each filter element having opposed surfaces lying essentially in parallel planes and substantially coextensive with the opposed perforated surfaces and arranged so that gas passing through the cartridge must pass through each filter element.

37. A cartridge filter according to claim 36 wherein the hollow casing is a clear plastic holder composed of two interlocking parts.

38. A cartridge filter according to claim 37 wherein the flat perforated surfaces have perforations virtually throughout their entire extent so that all portions of the contained filter elements are essentially equally exposed to whatever passes through the cartridge.

39. A cartridge filter according to claim 38 wherein the pressure drop is at most 4.0 centimeters of water.

40. A filter according to claim 28, and further enclosed within a cartridge having a cylindrical hollow casing with two opposed essentially-flat perforated surfaces through which gas can pass, the hollow casing being filled with filter elements under compression and in a fixed sequence between one of the flat perforated surfaces and the other; each filter element having opposed surfaces lying essentially in parallel planes and substantially coextensive with the opposed perforated surfaces and arranged so that gas passing through the cartridge must pass through each filter element.

41. A cartridge filter according to claim 40 wherein supporting and protecting means (d) is absorbent means which traps moisture.

42. A cartridge filter according to claim 40, in combination with a moldable polymeric face mask which is adaptible to cover a wearer's mouth and nostrils and which has and gas-outlet valve means, the filter being enclosed in a cartridge in a manner in which, said cartridge is removably secured to said mask.

43. A filter and facemask combination according to claim 42 wherein the removable cartridge filter is maintained in a vertical position in normal use.

44. A filter according to claim 28, and further enclosed within a cartridge having a cylindrical hollow casing with opposed upstream and downstream essentially-flat perforated surfaces through which gas can pass, the hollow casing being filled with filter elements under compression and in fixed sequence between one of the flat perforated surfaces and the other; each filter element having opposed surfaces lying essentially in parallel planes and substantially coextensive with the opposed perforated surfaces and arranged so that gas passing through the cartridge must pass through each filter element; the downstream essentially-flat perforated surface comprising sufficiently fine mesh to provide means (v) of claim 28.

45. A filter according to claim 28, in combination with a moldable polymeric face mask which is adapted to cover a wearer's mouth and nostrils and which has gas-outlet valve means, said filter being maintained in normal use in a vertical position.

46. A filter and facemask combination according to claim 45 wherein the filter elements are arranged so that air passing through the filter means from outside of the mask passes first through porous compressible means (i) and last through support means (vi) before being accessible to one who wears the mask.

47. A filter and facemask combination according to claim 46 wherein the polymeric face mask is flexible.

48. A filter and facemask combination according to claim 47 wherein said facemask is cosmetically - acceptable and which permits a user thereof to perform normal work activities in comfort.

49. A filter and facemask combination according to claim 48 which, in use, reduces gaseous, vaporous and particulate air contaminants to a safe level.

* * * * *